United States Patent [19]

Watkins

[11] Patent Number: 4,523,340

[45] Date of Patent: Jun. 18, 1985

[54] MEANS PROVIDING MOVING WATER STREAM EJECTING INTO SPA TANK

[75] Inventor: Jonathan Watkins, San Marcos, Calif.

[73] Assignee: Watkins Manufacturing Co., Carlsbad, Calif.

[21] Appl. No.: 451,030

[22] Filed: Dec. 20, 1982

[51] Int. Cl.[3] ..... A67H 33/02

[52] U.S. Cl. ..... 4/542; 4/492; 128/66

[58] Field of Search ..... 4/492, 490, 496, 541–544, 4/567–570; 239/229, 318, 426; 134/167; 128/66, 365–370

[56] References Cited

U.S. PATENT DOCUMENTS

| | | | |
|---|---|---|---|
| 902,529 | 9/1910 | Brown | 4/542 |
| 986,217 | 10/1911 | Doerr | 4/542 |
| 1,986,220 | 1/1935 | Russel | 239/229 |
| 2,772,421 | 12/1956 | Friend | 4/542 |
| 3,092,101 | 6/1963 | Kinney | 4/542 |
| 3,286,712 | 11/1966 | Roden | 4/542 |
| 3,315,692 | 4/1967 | Arneson | 239/229 X |
| 3,391,411 | 7/1968 | Miller | 4/542 |
| 3,420,226 | 1/1969 | Berry | 4/542 |
| 3,452,370 | 7/1969 | Jacuzzi | 4/542 |
| 3,474,469 | 10/1969 | Steltz | 4/542 |
| 3,820,172 | 6/1974 | Kane | 4/490 |
| 3,840,183 | 10/1974 | Kuribayashi | 239/318 X |
| 4,044,953 | 8/1977 | Vogel | 239/229 |
| 4,142,337 | 3/1979 | Holcomb | 4/542 |
| 4,166,296 | 9/1979 | Darrah | 4/542 |
| 4,170,044 | 10/1979 | Steimie | 4/542 |
| 4,220,145 | 9/1980 | Stamp et al. | 4/542 X |
| 4,225,984 | 10/1980 | Lindsey | 4/542 |
| 4,230,276 | 10/1980 | Tinder et al. | 239/229 |
| 4,233,694 | 11/1980 | Janosko | 4/542 |
| 4,339,833 | 7/1982 | Mandell | 4/542 |
| 4,346,484 | 8/1982 | Martin | 4/492 |

*Primary Examiner*—Charles E. Phillips
*Attorney, Agent, or Firm*—Duane C. Bowen

[57] ABSTRACT

In a spa tank, a flexible exhaust water tube pivoting in a vertical plane exhausting a massaging water stream on the back of the user. The assembly is adjustable to govern rate of whipping of the exhaust tube and nozzle. The nozzle is buoyant and adds air to the exhaust water stream. Low-wear roller abutments are pressed by the exhaust water tube as bend points in undulating reversal movements at the top and bottom of the pivotal movement of the tube.

17 Claims, 5 Drawing Figures

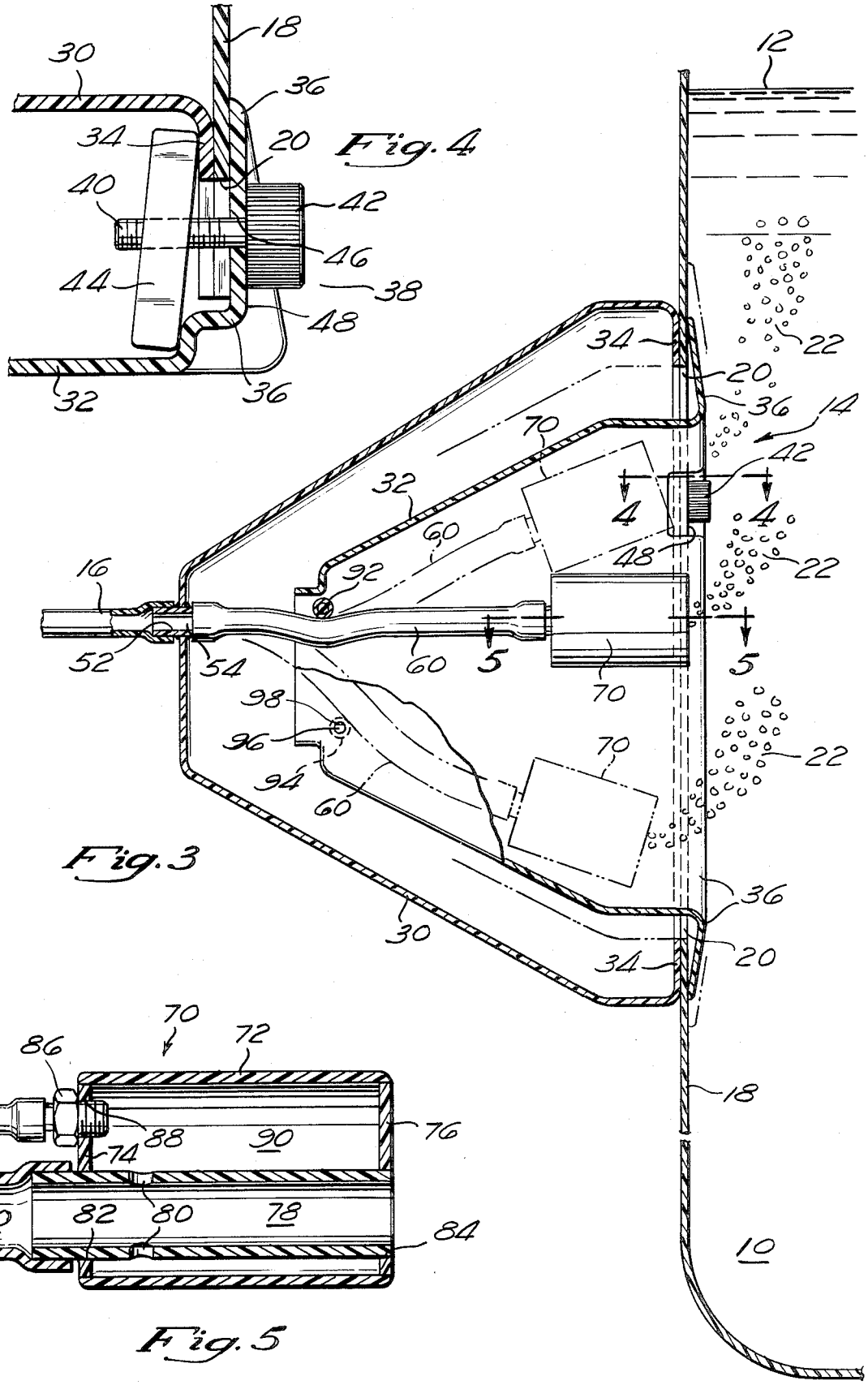
Fig. 4
Fig. 3
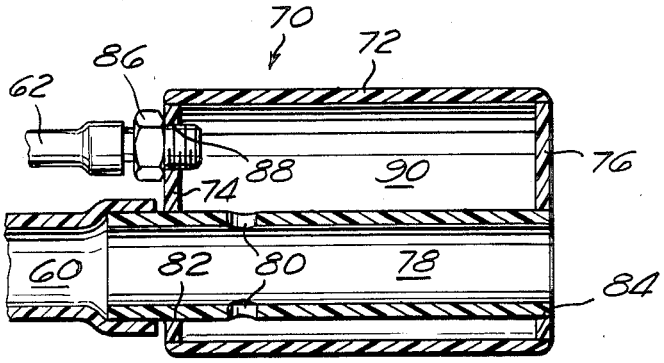
Fig. 5

MEANS PROVIDING MOVING WATER STREAM EJECTING INTO SPA TANK

BRIEF SUMMARY OF THE INVENTION, BACKGROUND AND OBJECTIVES

My invention relates to means to eject water, with entrained air, into a spa tank in the form of a moving water stream whipping back and forth in a single plane so that occupants can subject their bodies to the massaging action of a moving pressurized stream.

The present invention concerns improvements over my prior invention disclosed in U.S. patent application Ser. No. 06/243,724, filed 3-16-81.

The improvements have several aspects including the following and it is an objective of my invention to provide those improvements:

(a) To provide ready adjustments by the user to ensure movement of the nozzles, from which water ejects, under various conditions.

(b) To provide a buoyant nozzle to position the nozzle properly to start the system. More specifically, to provide buoyancy in the nozzle by using the water stream to draw water into a buoyancy chamber in a Venturi manner, and to devise a nozzle of economical construction.

(c) To devise abutments intermediate the ends of a flexible reciprocating tube, through which the water ejects, to form bend points for reversal of the movement of the tube in an undulating manner. Additionally, to provide such abutments in the form of rollers to reduce tube wear.

My invention will be best understood, together with additional advantages thereof, when read with reference to the drawings.

THE DRAWINGS

FIG. 3 is an enlarged side view of the structure depicted in FIG. 1, shown partly in section.

FIG. 4 is an enlarged view, partly in section , of one of the clip-type securing members. The view is taken on line 4—4 of FIG. 3.

FIG. 5 is an enlarged view, partly in section, of the nozzle. The view is taken on line 5—5 of FIG. 3.

DESCRIPTION

Figure 1:
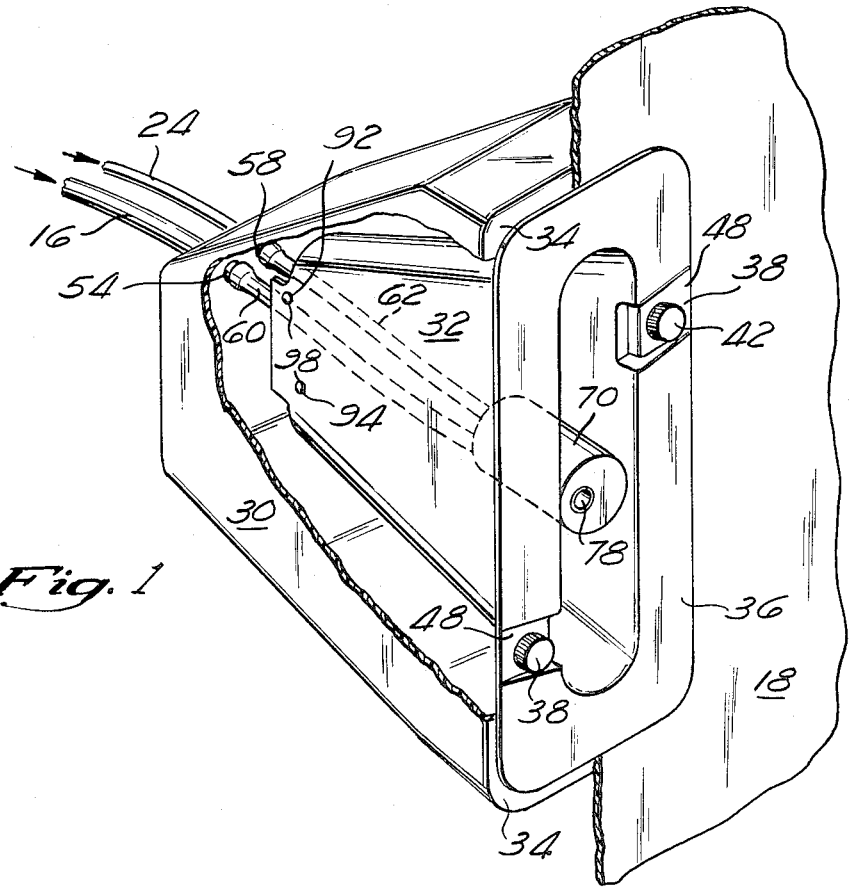
FIG. 1 is a perspective view of portions of the tank of a spa or the like, incorporating a specific embodiment of my moving nozzle structure. Portions of the structure are broken away to better illustrate the construction.
Figure 2:
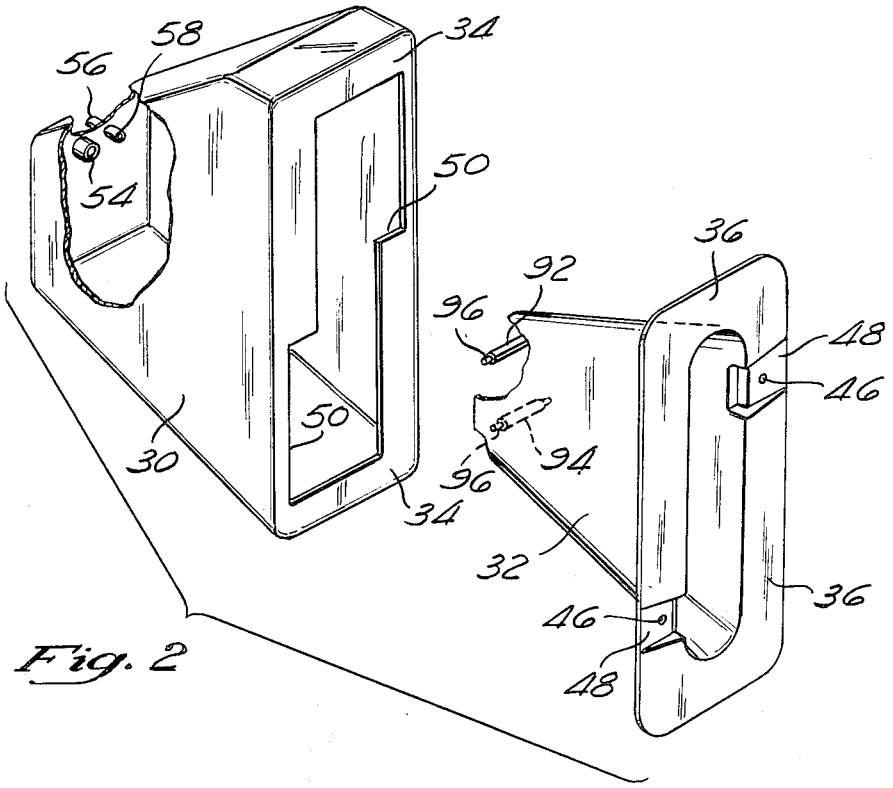
FIG. 2 is an exploded perspective view in the same orientation as FIG. 1 and showing inner and outer housings.

Reference is made to the above-identified prior patent application to give background and setting of the present invention, so that there will not be unnecessary repetition of description herein.

The present invention applies to a spa or the like. The part shown in the drawings are to be taken as being installed in a spa having a water tank 10 to the right side as viewed in FIG. 3. In contemporary products, the word "spa" is used as the name of a product having a tank or pool of heated water and having one or more water jets, frequently with entrained air, ejecting into the body of water beneath its surface, so that the users of the spa can enjoy the water streams either directly or indirectly depending on how close they get to the jets. The water jets are fed by pumped recirculated water.

Such a spa differs from the product called a "hot tub" by having the water jets. It will be understood that tank 10 is filled with water to some level, such as 12. The spa may have one or more stationary water jets in addition to one or more moving water jet installations 14 as illustrated herein. A pump, not shown, withdraws heated water from the tank and has a delivery line 16 connecting to each moving water jet installation 14. The vertical tank wall 18 has a slot 20 elongated vertically through which the moving water-air stream 22 of installation 14 ejects. Water-air stream 22 is shown as reciprocating vertically. A user backed up against stream 22 would be massaged up and down the spine. It will be understood that usually stream 22 will eject under water.

Usually air will be injected into stream 22 by vacuum, in a Venturi manner, and will not be pressurized. Air delivery line 24 may be assumed to be vented to the atmosphere at its upstream end and to have its downstream end connected to installation 14.

An outer housing 30 and an inner housing 32 are installed with outer housing on the outside of tank wall 18 around slot 20 and with inner housing 32 extending through slot 20. Housings 30,32 can be molded from plastic or formed from a fiberglass reinforced resin. Outer housing 30 has an inwardly directed flange 34 abutting the outside of wall 18, and inner housing 32 has an outwardly directed flange 36 abutting the inside of wall 18. Flange 34 is secured to wall 18, as by bonding, in fixed relationship to slot 20.

Housing 32 is vertically adjustable relative to tank wall 18, to wall slot 20, and to housing 30. By this means the user can adjust installation 14 to insure movement of stream 22 and/or to adjust the rate of movement of stream 22. Flange 36 is slidably adjustable on the inside of tank wall 18.

Flange 36 and inner housing 32 are secured and adjusted in positions by clips 38 which include a bolt 40, a knob 42 on bolt 40, and a loosely or pivotally mounted toggle 44 on bolt 40. Toggle 44 bears on flanges 34, 36, bolt 40 extends through an opening 46 in flange 36, and knob 42 bears on flange 36 to adjustably secure inner housing 32 in position. Flange 36 has recesses 48 at the locations of knobs 42. It will be noted that flange 34 is cut back at locations 50 to accommodate the various positions of clip assemblers 38.

Housings 34, 36 are fan-shaped or inwardly flared in a vertical plane to accommodate the swinging movement of the water jet tube and nozzle. Outer housing 30 has inner and outer water and air nipples 52, 54, 56, 58. Water delivery line 16 is connected to nipple 52 and air delivery line 24 is connected to nipple 56.

The basic flexing member in the assembly is the whipping water exhaust tube 60. Parallel to tube 60 is a smaller flexing air tube 62. Tubes 60, 62 are suitably connected to nipples 54, 58 respectively.

Part of the characteristics of the whipping of the assembly is determined by the larger tube 60 as to its dimensions and as to the type of material used. One important consideration is durability not only as to the flexing but as to abrasion resistance in contacting certain abutments later to be described.

In the material presently used, about $\frac{5}{8}''$ I.D. and about a $\frac{3}{4}''$ O.D. is suitable (about 1.6 cm. I.D. and about a 1.9 cm. O.D.) A catalyzed silicone rubber is used, manufactured by General Electric Company. This is a proprietary material of G.E. called "TUFEL" and one property is a 40 Shore "A" durometer hardness reading.

A plastic nozzle 70 is suitably connected to the other ends of tubes 60, 62. One feature of nozzle 70 is economy of manufacture. The nozzle includes a larger tube 72, plugs 74, 76 closing the ends of tube 72, a smaller tube 78, ports 80 through smaller tube 78 communicating with the interior of tube 72, openings 82, 84 in plugs 74, 76 receiving smaller tube 78 (which is suitably secured therein), and a fitting 86 threadedly secured in an opening 88 in plug 74. Water tube 60 is suitably secured to an end of smaller tube 78 and air tube 62 is suitably secured to fitting 86. It will be understood this is an economical method of manufacture, involving such things as cutting lengths of tubing, boring holes, and bonding member together.

A basic function of the nozzle is to draw air into the water stream exhausting from water tube 60 and passing through smaller tube 78. Because tube 78 has ports 80 to the air chamber 90 in tube 72, passage of a pressurized stream through tube 78 at some velocity results in drawing air into the water stream by vacuum in a Venturi manner. The addition of air adds to the thrust of the stream 22 ejecting from tube 78, which means the user will feel more pressure from stream 22 and which means stream 22 has more thrust to propel nozzle 70, tube 60, etc., in a whipping manner. The effect of the addition of air to stream 22 has been demonstrated in an installation wherein nozzle 70 and tube 60 are whipping satisfactorily and air is blocked off from supply tube 62 whereupon nozzle 70 and tube 60 stall by reason of insufficient thrust. This is not to say that nozzle 70 and tube 60 could not be made to move without addition of air. This could be done by adding more energy to the water stream in terms of volume, pressure of velocity, but the observation merely is that the air does add thrust.

A further feature of nozzle 70 is that the construction does provide floatation to the nozzle. Nozzle 70 otherwise could be made floatable but the way the floatation is provided herein is by providing an air chamber 90, etc. When the moving nozzle is originally activated it would be bending down under the force of gravity. As the water begins to pass through tube 78, this may or may not be enough to raise nozzle 70, but as the water continues to exhaust, water filling chamber 90 is exhausted by Venturi vacuum action and is replaced by air drawn through tube 62 and nozzle 70 then becomes buoyant and rises. As nozzle 70 rises, the whipping action of tube 60 and nozzle 70 begins. When nozzle 70 is in an upper position, it has a better attitude to begin the whipping movement.

There are likely to be variables in any particular spa or the like which affect rate of whipping of tube 60 and nozzle 70 and may even involve failure of tube 60 and nozzle 70 to move at all. Such factors may include:

(a) Depth of water in the spa. Nozzle 70 thrusts against a head of pressure of water in spa tank 10. The more water above the nozzle the higher the pressure. Of course the pressure will be higher at the lower positions of nozzle 70 than at the higher positions.

(b) Pump pressure, velocity of water flow, and other related factors including effective minimum diameters for flow of air and water to nozzle 70.

It has been found useful in obtaining whipping movement of tube 60 and nozzle 70 to provide upper and lower abutments 92, 94 intermediate the ends of tube 60 providing bend points initiating undulation in the reversal movement of tube 60 at opposite upper and lower ends of its path of travel. Use of abutments 92, 94 also affect rate of movement (rate of reversal) of tube 60. Note abutments 92, 94 are supported on inner housing 30, which means that as inner housing 30 is adjusted vertically by use of clips 38 the locations of abutments 92, 94 are changed. This means abutments 92, 94 are adjustable in height. When abutments 92, 94 are adjusted, the rate of movement of nozzle 70 is affected. In fact, abutments 92, 94 is some circumstances may be adjusted from positions in which nozzle 70 will not move to positions in which nozzle 70 will move. If the location of abutments 92, 94 are studied, it will be realized that when tube 60 contacts an abutment 92, 94, thereafter tube 60 bends at a greater rate than otherwise would be the case in angles of thrust directed towards reversal of movement of nozzle 70.

Note that the level of nipples 54, 58 about which tubes 60, 62 bend is higher than half of the vertical extents of housings 30, 32. This is because of factors such as different heads of pressure at the upper and lower portions of housings 30, 32 and the fact when the system is shut off, tubes 60, 62 will droop under gravity. When nozzle 70 is in this drooped disposition, the ejecting stream 22 from nozzle 70 upon startup is aligned at a favorable angle to move nozzle 70 upwardly, i.e., the angle has a higher vertical vector than it would have in a symmetrical installation.

Tubes 60, 62 and nozzle 70 are guided to move in a vertical plane partly by having tube pivot points and abutments aligned horizontally. Tubes 60, 62 have further guides, when needed, by opposite vertical walls of inner housing 16 restricting movement to a vertical plane.

Wear on tube 60 at bend points 92, 94 proved to be excessive. To take care of this situation, I devised use of rollers to form abutments 92, 94. These rollers can be formed of plastic with reduced ends 96 rotatably supported by openings 98 in inner housing 32. Rolling of abutments 92, 94, when pressed by tube 60, has resulted in satisfactory resistance to abrasion of tube 60.

The foregoing explains the adjustment of the nozzle assembly, the provision of a buoyant nozzle, and the use of adjustable roller abutments as bend points in reversal of the pivoting exhaust water tube.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. The improvement in a spa or the like that includes a tank containing water for body immersion and a flexible exhaust tube directed to exhaust water into said tank from a side thereof and a source of pressurized water connected to said exhaust tube, said exhaust tube having a free end adapted to whip by reaction to water exhausting therefrom and guide means guiding said exhaust tube to swing substantially in a single vertical plane, the improvement, comprising:

(a) a nozzle secured to said free end of said exhaust tube and an air line secured to said nozzle and extending generally parallel to said exhaust tube, (b) said nozzle being formed by a larger rigid tube and end plugs for said larger tube, a smaller tube extending through said larger tube and openings in said plugs to pass said smaller tube, the free end of said exhaust tube being secured to said smaller tube, said air line connecting to said larger rigid tube at a location alongside said smaller tube and said smaller tube having side ports whereby the inside of said larger tube forms a floatation chamber receiving air from said air tube and exhausting air from said chamber in a Venturi manner through said ports into the water stream passing through said smaller tube during exhaust of pressurized water through said exhaust tube, (c) housing means for said tube including opposite sidewalls forming said guide means for said tube, (d) said tube having a fixed portion secured to said housing means with said free end extending inwardly therefrom towards the inside of said tank and means forming a pair of upper and lower abutments above and below said tube and spaced from said fixed portion of said tube in a direction toward the inside of said tank and said abutments forming bend points in undulating reversal movement of said tube at each end of the path of travel of said tube, (e) said abutments being formed by a pair of rollers, (f) said housing means including an outer housing for said tube to which said tube is secured with said free end extending inwardly therefrom towards the inside of said tank and an inner housing inside of said outer housing having opposite sidewalls forming said guide means for said tube, and (g) said housings being mounted for relative vertical adjustment therebetween to adjust for the path of travel of said free end of said tube.

2. The improvement in a spa or the like that includes a tank containing water for body immersion and a flexible exhaust tube directed to exhaust water into said tank from a side thereof and a source of pressurized water connected to said exhaust tube, said exhaust tube having a free end adapted to whip by reaction to water exhausting therefrom and guide means guiding said exhaust tube to swing substantially in a single vertical plane, the improvement, comprising:

(a) a nozzle secured to said free end of said exhaust tube and an air line secured to said nozzle and extending generally parallel to said exhaust tube, (b) said nozzle being formed by a larger rigid tube and end closures for said larger tube, a smaller tube extending through said larger tube and openings in said closures to pass said smaller tube, the free end of said exhaust tube being secured to said smaller tube, said air line connecting to said larger rigid tube at a location alongside said smaller tube and said smaller tube having side ports whereby the inside of said larger tube forms a floatation chamber receiving air from said air tube and exhausting air from said chamber in a Venturi manner through said ports into the water stream passing through said smaller tube during exhaust of pressurized water through said exhaust tube, (c) housing means for said tube including opposite sidewalls forming said guide means for said tube, and (d) said tube having a fixed portion secured to said housing means with said free end extending inwardly therefrom towards the inside of said tank and means forming a pair of upper and lower abutments above and below said tube and spaced from said fixed portion of said tube in a direction toward the inside of said tank and said abutments forming bend points in undulating reversal movement of said tube at each end of the path of travel of said tube.

3. The improvement in a spa or the like that includes a tank containing water for body immersion and a flexible exhaust tube directed to exhaust water into said tank from a side thereof and a source of pressurized water connected to said exhaust tube, said exhaust tube having a free end adapted to whip by reaction to water exhausting therefrom and guide means guiding said exhaust tube to swing substantially in a single vertical plane, the improvement, comprising:

(a) a nozzle secured to said free end of said exhaust tube and an air line secured to said nozzle and extending generally parallel to said exhaust tube, and (b) said nozzle being formed by a larger rigid tube and end plugs for said larger tube, a smaller tube extending through said larger tube and openings in said plugs to pass said smaller tube, the free end of said exhaust tube being secured to said smaller tube, said air line connecting to said larger rigid tube at a location alongside said smaller tube and said smaller tube having side ports whereby the inside of said larger tube forms a floatation chamber receiving air from said air tube and exhausting air from said chamber in a Venturi manner through said ports into the water stream passing through said smaller tube during exhaust of pressurized water through said exhaust tube.

4. The improvement in a spa or the like that includes a tank containing water for body immersion and a flexible exhaust tube directed to exhaust water into said tank from a side thereof and a source of pressurized water connected to said exhaust tube, said exhaust tube having a free end adapted to whip by reaction to water exhausting therefrom and guide means guiding said exhaust tube to swing substantially in a single vertical plane, the improvement, comprising:

(a) a nozzle secured to said free end of said exhaust tube and an air line secured to said nozzle and extending generally parallel to said exhaust tube, and (b) said nozzle having an air floatation chamber adding buoyancy to said nozzle and said air line connecting to said air chamber, a water passageway through said nozzle connecting to said exhaust tube and exhausting into said tank, and connecting port means between said air chamber and said water passageway whereby air is exhausted from said chamber in a Venturi manner through said port means into the water stream passing through said water passageway during exhaust of pressurized water through said exhaust tube.

5. The improvement in a spa or the like that includes a tank containing water for body immersion and a flexible tube directed to exhaust water into said tank from a side thereof and a source of pressurized water connected to said tube, said tube having a free end adapted to whip by reaction to water exhausting therefrom and guide means guiding said tube to swing substantially in a single vertical plane, the improvement, comprising:

(a) said tube having a portion fixedly secured relative to said tank with said free end extending inwardly therefrom towards the inside of said tank and means forming a pair of upper and lower abutments above and below said tube and spaced from said fixedly secured portion of said tube in a direction toward the inside of said tank and said abutments forming bend points in undulating reversal movement of said tube at each end of the path of travel of said tube, and (b) said abutments being formed by a pair of rollers.

6. The improvement in a spa or the like that includes a tank containing water for body immersion and a flexible tube directed to exhaust water into said tank from a side thereof and a source of pressurized water connected to said tube, said tube having a free end adapted to whip by reaction to water exhausting therefrom and guide means guiding said tube to swing substantially in a single vertical plane, the improvement, comprising:

(a) said tube having a portion fixedly secured relative to said tank with said free end extending inwardly therefrom towards the inside of said tank and means forming a pair of upper and lower abutments above and below said tube in a direction toward the inside of said tank and said abutments forming bend points in undulating reversal movement of said tube at each end of the path of travel of said tube, (b) an outer housing for said tube to which said fixedly secured portion of said tube is fastened and an inner housing inside of said outer housing having opposite sidewalls forming said guide means guiding said tube, said housing flaring in a direction towards the inside of said tank, said abutments located at the end of said inner housing away from said tank, and (c) said abutments being formed by upper and lower parallel rollers rotatably mounted on said inner housing.

7. The improvement in a spa or the like that includes a tank containing water for body immersion, comprising:

(a) a flexible tube directed to exhaust water into said tank from a side thereof and a source of pressurized water connected to said tube, said tube having a free end adapted to whip by reaction to water exhausting therefrom and means causing said tube to swing substantially in a single vertical plane, and (b) a nozzle near said free end of said tube and air line means connecting to said nozzle, and said nozzle having means including air port means operative to inject air from said air line means into the water stream exhausting through said nozzle in the manner of a Venturi due to vacuum created by movement of water through said nozzle, to increase nozzle thrust in order to better achieve whipping of said tube.

8. The improvement in a spa or the like that includes a tank containing water for body immersion, comprising:

(a) a flexible tube directed to exhaust water into said tank from a side thereof and a source of pressurized water connected to said tube said tube having a free end adapted to whip by reaction to water exhausting therefrom and guide means guiding said tube to swing substantially in a single vertical plane, (b) said tube having a portion fixedly secured relative to said tank with said free end extending inwardly therefrom towards the inside of said tank and means forming a pair of upper and lower bending-point line-like abutments above and below said tube and spaced from said fixedly secured portion of said tube in a direction toward the inside of said tank and said abutments being so located as to form bend points and said tube being sufficiently flexible as to produce undulating reversal movement of said tube at each end of the path of travel of said tube, and (c) support means for said upper and lower abutments that is adjustable to change the location of said abutments vertically relative to said fixedly secured portion of said tube.

9. The subject matter of claim 8 in which said support means is manually operable to adjust the location of said abutments.

10. The improvement in a spa or the like that includes a tank containing water for body immersion, comprising:

(a) a flexible tube directed to exhaust water into said tank from a side thereof and a source of pressurized water connected to said tube, said tube having a free end adapted to whip by reaction to water exhausting therefrom and guide means guiding said tube to swing substantially in a single vertical plane, (b) an outer housing for said tube with a backwall and walls on all sides of said tube, said tube being secured to said backwall with said free end extending inwardly therefrom towards the inside of said tank and an inner housing inside of said outer housing with walls on all sides of said tube and having opposite sidewalls forming said guide means for said tube, and (c) one of said housings being mounted for relative vertical adjustment with respect to the other of said housings to adjust for the path of travel of said free end of said tube.

11. The subject matter of claim 10 in which said abutments are formed by a pair of parallel rollers.

12. The subject matter of claim 11 in which said housings flare toward the inside of said tank, said tube is secured to said outer housing closer to the top than the bottom of said outer and inner housings.

13. The subject matter of claim 12 in which there is a pair of upper and lower abutments on said inner housing above and below said tube at the end of the inner housing away from said tube, said abutments forming bend points in undulating reversal movement of said tube at each end of the path of travel of said tubes, the upper abutment being near the level of the connection of the tube to the outer housing and the lower abutment being substantially below the level of the connection of the tube to the outer housing.

14. The subject matter of claim 13 in which said abutments are formed by a pair of parallel rollers.

15. The subject matter of claim 13 in which there is a buoyant nozzle at said free end of said tube.

16. The subject matter of claim 15 in which there is a pair of upper and lower abutments in said inner housing and supported by said inner housing above and below said tube at the end of the inner housing away from said tank, said abutments forming bend points in undulating reversal movement of said tube at each end of the path of travel of said tubes, the locations of said abutments relative to said flexible tube changing as said housings are relatively vertically adjusted because said tube is secured to said outer housing and said abutments are supported by said inner housing.

17. The improvement in a spa or the like that includes a tank containing water for body immersion and a flexible tube directed to exhaust water into said tank from a side thereof and a source of pressurized water connected to said tube, said tube having a free end adapted to whip by reaction to water exhausting therefrom and guide means guiding said tube to swing substantially in a single vertical plane, the improvement, comprising:

(a) a nozzle secured to said free end of said tube and means producing buoyancy in said nozzle, and (b) said means producing buoyancy in said nozzle being an air chamber in said nozzle and an air line to said air chamber.

* * * * *